US005273455A

United States Patent [19]

MacLellan

[11] Patent Number: 5,273,455

[45] Date of Patent: Dec. 28, 1993

[54] TORSION BAR CONNECTOR

[75] Inventor: Lance MacLellan, Hudson, Mass.

[73] Assignee: Digital Equipment Corporation, Maynard, Mass.

[21] Appl. No.: 10,222

[22] Filed: Jan. 27, 1993

[51] Int. Cl.[5] ..... H01R 13/00

[52] U.S. Cl. ..... 439/387; 439/848

[58] Field of Search ..... 439/387, 433, 434, 848, 439/816, 825, 682

[56] References Cited

U.S. PATENT DOCUMENTS

| | | | |
|---|---|---|---|
| 2,408,583 | 10/1946 | Sions | 173/361 |
| 2,926,328 | 2/1960 | Flanagan | 339/192 |
| 3,333,226 | 7/1967 | Donnelly | 339/17 |
| 3,786,401 | 1/1974 | Jones et al. | 339/258 |
| 3,829,820 | 8/1974 | Hubner et al. | 339/88 |
| 4,025,148 | 5/1977 | Bouley | 339/176 |
| 4,105,277 | 8/1978 | Jacobs | 439/825 |
| 4,735,588 | 4/1988 | Bird et al. | 439/816 |
| 4,941,853 | 7/1990 | Harwath | 439/848 |

*Primary Examiner*—Joseph H. McGlynn

*Attorney, Agent, or Firm*—A. Sidney Johnston; Albert P. Cefalo; Barry N. Young

[57] ABSTRACT

An electrical connector system includes a torsion bar spring for maintaining good contact forces in small sizes, simple configurations and controlled connector insertion forces. The electrical connector system includes a first and a second terminal. The first terminal has two electrical contacts connected by a shaft. The shaft is made of a resiliently deflectable electrically conductive material. The second terminal is a helically-shaped hollow body adapted to receive the first terminal. When the first terminal is inserted in the second terminal, the shaft of the first terminal is deflected and acts as a torsion bar spring and the two contacts lock the torque inside the second terminal. An alternative embodiment includes a first terminal with protrusions and a second terminal with a helical groove on its interior surface which receive the protrusions of the first terminal and cause the first terminal to deflect on insertion into the second terminal. The terminals may be mounted to form plug and socket apparatus.

14 Claims, 10 Drawing Sheets

TORSION BAR CONNECTOR

FIELD OF THE INVENTION

The present invention relates generally to electrical connector systems, and more particularly to electrical contact structures with torsion bars for maintaining electrical contact forces.

BACKGROUND OF THE INVENTION

It is a known problem in electrical systems to make reliable electrical connections between contact terminals in mated electrical connectors. Generally, an electrical connection is established by creating a contact force between the contact terminals. A strong contact force helps to reduce oxidation of the contact terminals and maintains the connection when the terminals are subjected to vibration or shock. Without a strong contact force, the electrical connection may disengage over time through creep of the contact terminals.

It is also a problem to make electrical connections which may be disconnected and reconnected easily without damage to the connectors. Strong contact forces result in high insertion forces when mating multi-terminal connectors, making the connection difficult to achieve and often damaging the contact terminals during repetitive connection and disconnection processes.

One device used to create the contact force in electrical connectors is to make the contact terminals in the form of cantilever beam springs which are deflected when the connectors are mated together. In electrical connectors of the cantilever beam spring type that have a large number of terminals, the cumulative insertion force can be relatively high. Reducing the contact force at the individual terminals effectively reduces the insertion force but results in a poor electrical connection. Also, the increasing need to miniaturize electrical connectors and the related need to reduce the size of each contact terminal, causes difficulty in forming the contact terminal as a cantilever beam spring which is strong enough to form a good contact.

Another technique used to create the contact force in electrical connectors uses a torsion bar. Torsion bar connector systems can generally be made smaller than cantilever beam spring systems and yet achieve relatively high contact forces. Known prior art torsion bar connector systems typically included a first contact terminal in the form of a rod which is inserted into a second contact terminal in the form of a helically-shaped sleeve. The rod acts as the spring portion to which torque is applied by the sleeve upon insertion to physically engage the rod with the sleeve. In current designs, however, the torque is also applied to the points at which the terminals are mounted, placing undesirable stress on the rod, sleeve and mounting points. Also, the current designs do not address the problem of high insertion forces in multi-terminal connectors.

SUMMARY OF THE INVENTION

The problems of cumulative high insertion forces and application of torque to the mounting points of the terminals are solved by the present invention of a torsion bar connector comprising a first and a second terminal where the first terminal has two electrical contacts connected by a shaft made of a resiliently deflectable material. The second terminal has an elongated tubular shape. The interior surface of the second terminal defines substantially a helix and is adapted to receive the first terminal. When the first terminal is inserted in the second terminal, the shaft of the first terminal is deflected and acts as a torsion bar spring and the two contacts lock the torque inside the second terminal.

BRIEF DESCRIPTION OF THE DRAWINGS

The present invention together with the above and other advantages may best be understood from the following detailed description of the embodiments of the invention illustrated in the drawings, wherein.

DETAILED DESCRIPTION

Figure 1A:
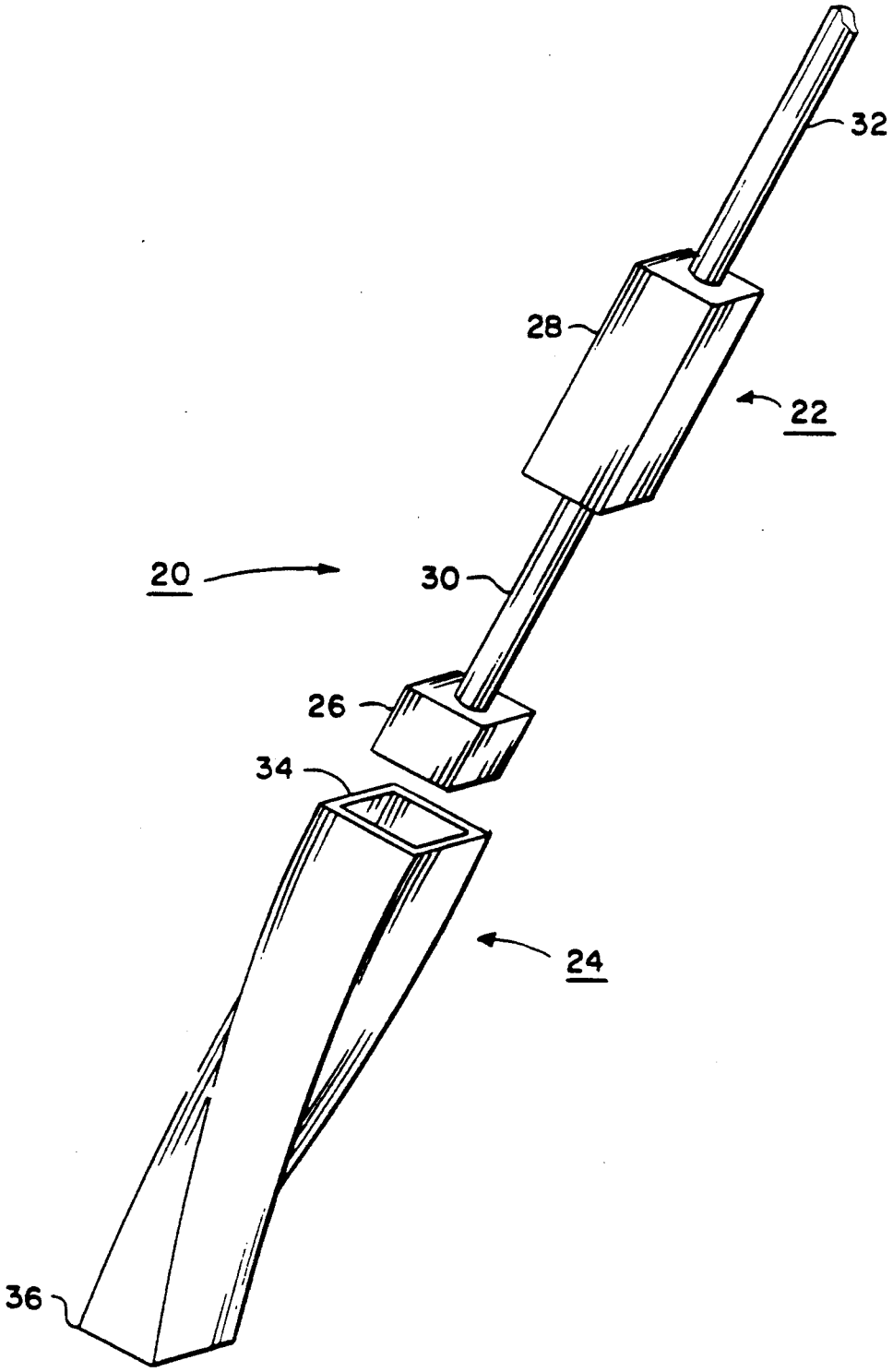
FIG. 1A is a perspective view of a connector assembly.

Referring now to the drawings, FIG. 1A shows an electrical connector system, generally designated as 20, constructed in accordance with one embodiment of the invention. The connector system 20 has a first electrical terminal 22 and a second electrical terminal 24. Terminal 22 is the insertion portion and includes a first rectangular contact 26 and a second rectangular contact 28, connected by a shaft 30 with a mounting shaft 32 extending from contact 28 for connection to other circuit elements. Terminal 22 may be formed from a single piece of resiliently deflectable electrically conductive material. Alternatively, terminal 22 may be formed of a highly electrically conductive inner material with a skin of electrically conductive high tensile strength material. Terminal 22 may also be formed from a resiliently deflectable electrically conductive rod with the contacts 26, 28 welded thereon.

Terminal 24 is the receiving portion of connector system 20. Terminal 24 has a helically-shaped rectangular tube 25 formed of electrically conductive material. The tube 25 has an opening at one end 34 for receiving terminal 22 and a mounting point 36 at the other end for connection to other circuit elements, not shown.

During operation of the connector system 20, the terminals 22, 24 are moved toward one another in an axial direction to mate and to establish the electrical connection. When the terminals 22 and 24 are mated, the first contact 26 and the second contact 28 are received into the terminal 24. During insertion, the receiving terminal 24 causes the first contact 26 to rotate about the axis of the terminal 22. The shaft 30 of the terminal 22 acts as a torsion bar and is subjected to torque as the first contact 26 rotates during insertion into the terminal 24. Mating is facilitated if the torque on the first contact 26 is not effective until the second contact 28 is engaged by the second terminal 24 by extending the tube 25 or by adjusting the curvature of the tube 25. Upon insertion of the second contact 28 into the terminal 24, the force of the torque on the shaft 30 is locked inside the terminal 24 and fully contained between the contacts 26 and 28. Because the force is fully contained between the contacts 26 and 28 at the time of full insertion, there are no stresses on the mounting shaft 32 or on the mounting point 36.

Figure 1B:
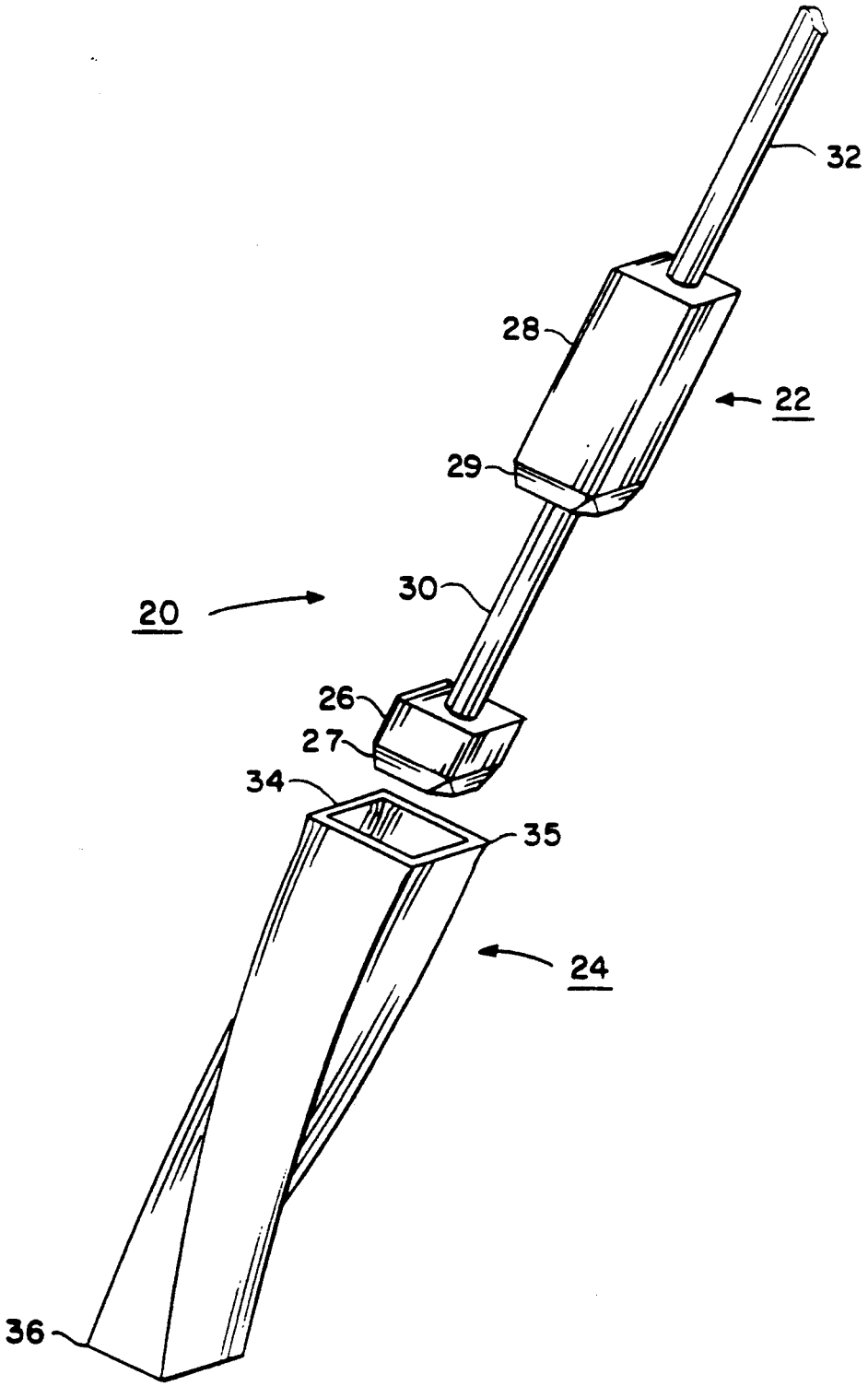
FIG. 1B is a perspective view of an alternative embodiment of the connector assembly shown in FIG. 1A.

FIG. 1B shows the electrical connector system 20 with a first modification of the first electrical terminal 22 and a second modification of the second electrical terminal 24. The first electrical terminal 22 includes a first rectangular contact 26 modified with a chamfered end 27 and a second electrical contact 28 modified with a chamfered end 29. The second electrical terminal 24 is a helically-shaped rectangular tube 25 modified with a flared portion 35 at the end 34 for receiving the terminal 22. The chamfered ends 27, 29 of contacts 26, 28 allow terminal 22 to engage easily with terminal 24. The flared portion 35 of terminal 24 permits easy acceptance of terminal 22. Either one of these modifications by itself will improve ease of mating in the electrical connector system 20.

Figure 2:
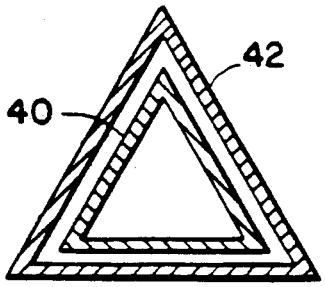
FIGS. 2-7 are sectional views of of connector assemblies constructed in accordance with alternative embodiments of the present invention.
Figure 5:
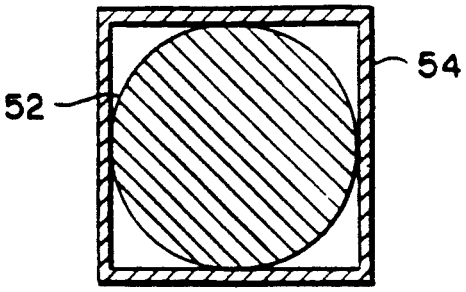
Figure 3:
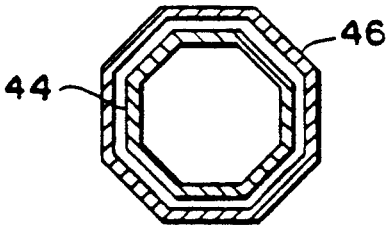
Figure 4:
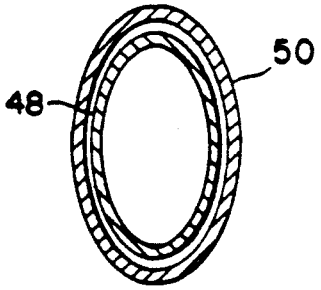
Figure 7:
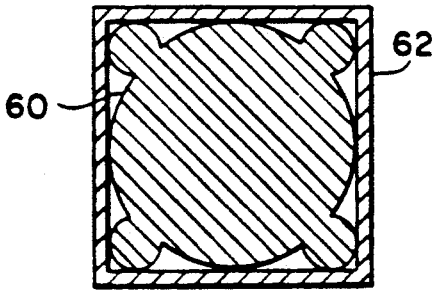
Figure 6:
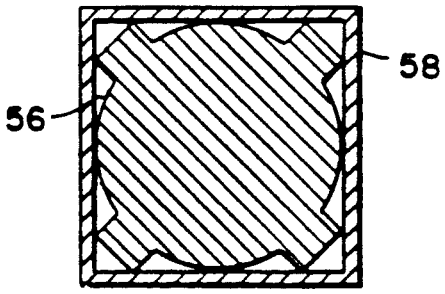

FIGS. 2–7 show cross-sections of various possible embodiments of the invention. The terminals 22 and 24 are not limited to rectangular shapes as shown in FIG. 1. In FIG. 2, inserted terminal 40 and receiving terminal 42 are triangular in crosssection. In FIG. 3, inserted terminal 44 and receiving terminal 46 are octagonal in cross-section. In FIG. 4, inserted terminal 48 and receiving terminal 50 are elliptical in cross-section. In FIG. 5, inserted terminal 52 is generally circular with flattened portions mating with the internal walls of receiving terminal 54 which is rectangular. In FIG. 6, inserted terminal 56 is generally circular with squared-off protrusions and receiving terminal 58 is rectangular. In FIG. 7, inserted terminal 60 is generally circular with round protrusions and receiving terminal 62 is rectangular.

The common features of the embodiments shown in FIGS. 2–7 are a first electrical terminal with two contacts connected by a resiliently deflectable shaft and a second electrical terminal having a helically-shaped tubular body which receives the first electrical terminal and causes a deflection of the shaft creating a torque which is locked between the two contacts and the interior surface of the second electrical terminal.

Figures 8, 9:
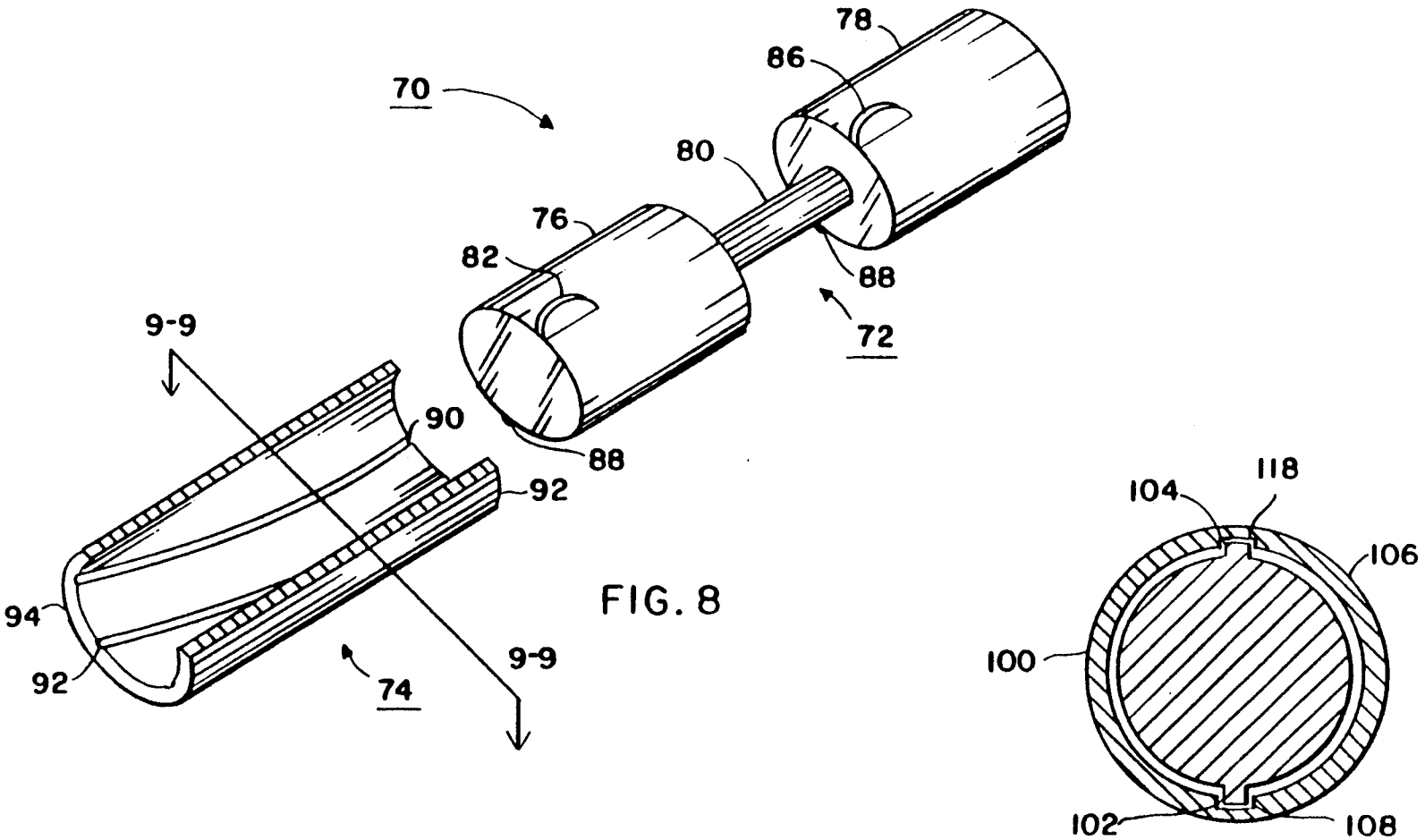
FIG. 8 is a perspective view of an alternative embodiment of a connector assembly constructed according to the present invention.
FIG. 9 is a sectional view along line 9—9 of the assembly shown in FIG. 8.

FIG. 8 shows an alternative embodiment of an electrical connector system generally designated as 70. The connector system 70 has a first electrical terminal 72 and a second electrical terminal 74. Terminal 72 is the insertion portion and includes a first electrical contact 76 and a second electrical contact 78, connected by a shaft 80. Both contacts 76 and 78 are cylindrical with protrusions 82, 84, 86, 88, found on generally opposing sides. The protrusions 82, 84, 86, 88 are located toward the lower end of each contact 76, 78, the end which is first engaged by the second terminal 74 upon insertion of the first terminal 72. Two protrusions per contact 76, 78 are shown in the drawing, but one protrusion or more than two protrusions per contact are also possible.

Second terminal 74, shown partially cut away, is the receiving portion of connector system 70. Terminal 74 is a hollow cylinder with grooves 90, 92 on an interior surface 94. The grooves 90, 92 match the protrusions on the contacts 76 and 78 of the first terminal 72.

During operation of the connector system 70, the terminals 72, 74 are moved toward one another in an axial direction to mate and to establish the electrical connection. When the terminals 72 and 74 are mated, the protrusions 82 and 84 of the first contact 76 and the protrusions 86 and 88 of the second contact 78 are lined up with the grooves 90 and 94 at the open, receiving end of the terminal 74. During insertion of the terminal 72 into the terminal 74, the protrusions 82, 84, 86, 88 slide along the grooves 90, 94 causing the first contact 76 to rotate about the axis of the terminal 72. The shaft 80 of the terminal 22 acts as a torsion bar and is subjected to torque as the contact 76 rotates during the mating of the terminals 72 and 74. Mating will be facilitated if the torque on the first contact 76 is not effective until the second contact 78 is engaged by the second terminal 74.

FIG. 9 shows a cross-section of the embodiment described above and shown in FIG. 8. Inserted terminal 100 is generally circular with two protrusions 102, 104. Receiving terminal 106 is cylindrical with two grooves 108, 110 placed and dimensioned to receive protrusions 102, 104.

Figure 10:
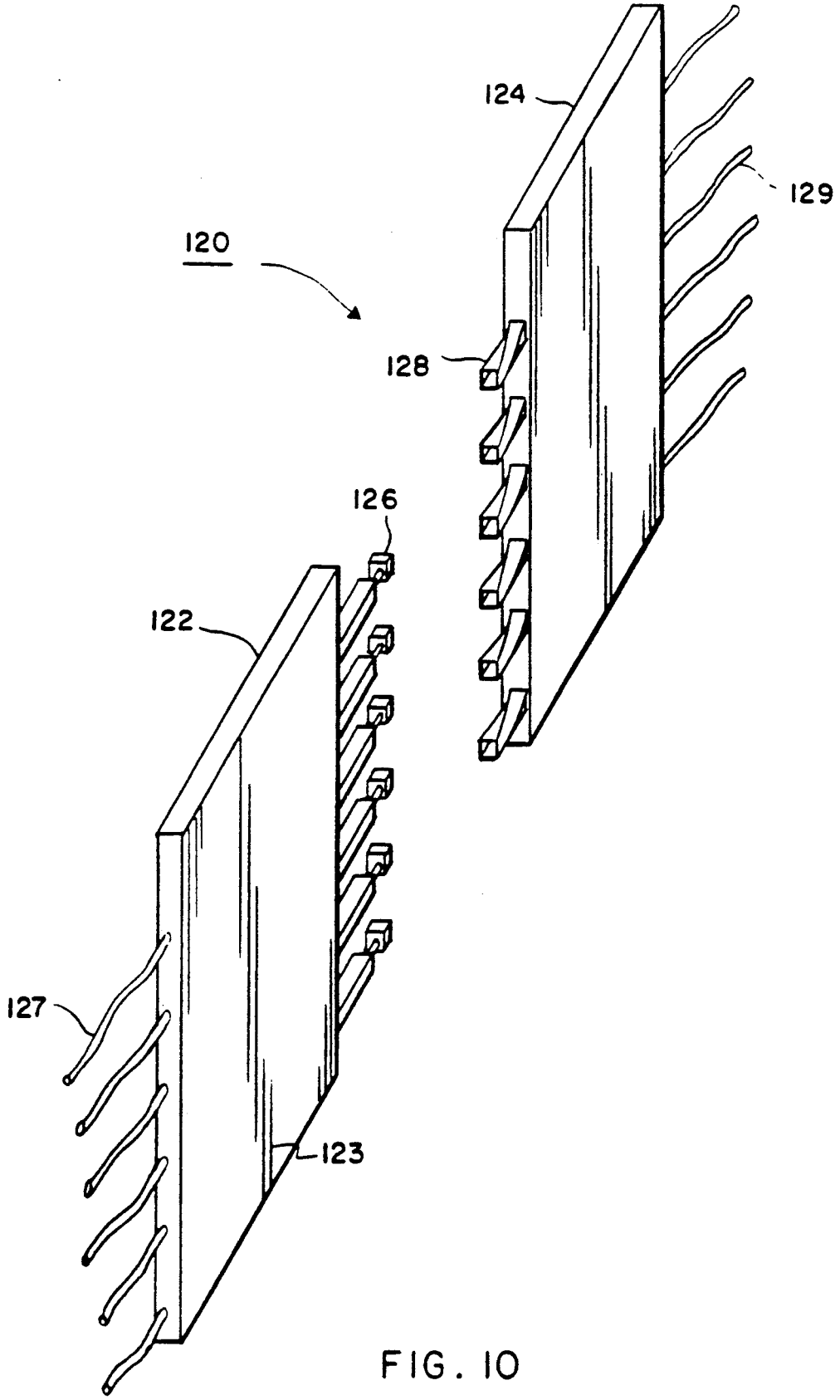
FIG. 10 is a perspective view of a multi-terminal connector assembly.

FIG. 10 shows a multi-terminal electrical connector system generally designated as 120 constructed in accordance with an embodiment of the invention. Connector system 120 has a plug apparatus 122 and a socket apparatus 124. Plug apparatus 122 has a plurality of first electrical terminals 126 each having two electrical contacts mounted in a block 123. A plurality of wires 127 extend from the plug apparatus 122 for connection to other circuit elements, not shown. Socket apparatus 124 has a plurality of second electrical terminals 128 whose interior surfaces define substantially a helix along the central axis. A plurality of wires 129 extend from the socket apparatus 124 for connection to other circuit elements, not shown. The terminals 126, 128 as shown are arranged in a single line, however, alternative configurations may include multiple rows and circular arrangements.

Figure 11:
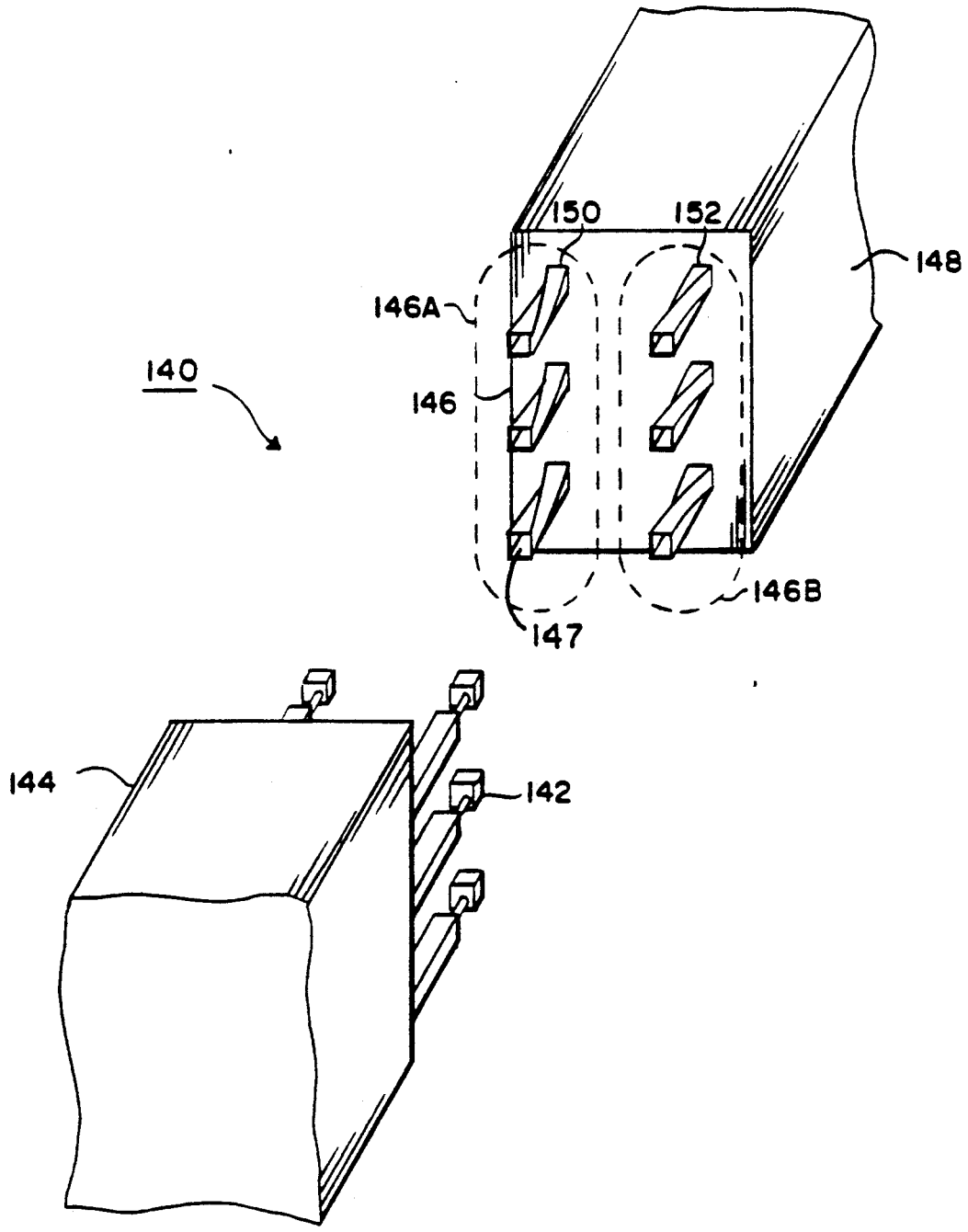
FIG. 11 is an alternative embodiment of a multi-terminal connector constructed in accordance with the present invention.

FIG. 11 shows an electrical connector system 140 where the insertion terminals 142 of the plug apparatus 144 and the receiving terminals 146 of the socket apparatus 148 are arranged in multiple rows. Interior surfaces 147 of the receiving terminals 146 define substantially helixes along the central axes of the terminals 146. The terminals 146A in the first row 150 define right-handed helixes while the terminals 146B in the second row 152 define left-handed helixes.

When mating a plug apparatus and socket apparatus of a multi-terminal connector where all the receiving terminals exert torque in the same direction, there is a tendency for the plug apparatus to twist and misalign. When mating a plug apparatus to a socket apparatus where each receiving terminal exerting torque in one direction is balanced by a terminal exerting torque in the opposite direction, as shown in FIG. 11, this tendency for the plug apparatus to be twisted to the right or the left is eliminated.

Figure 12:
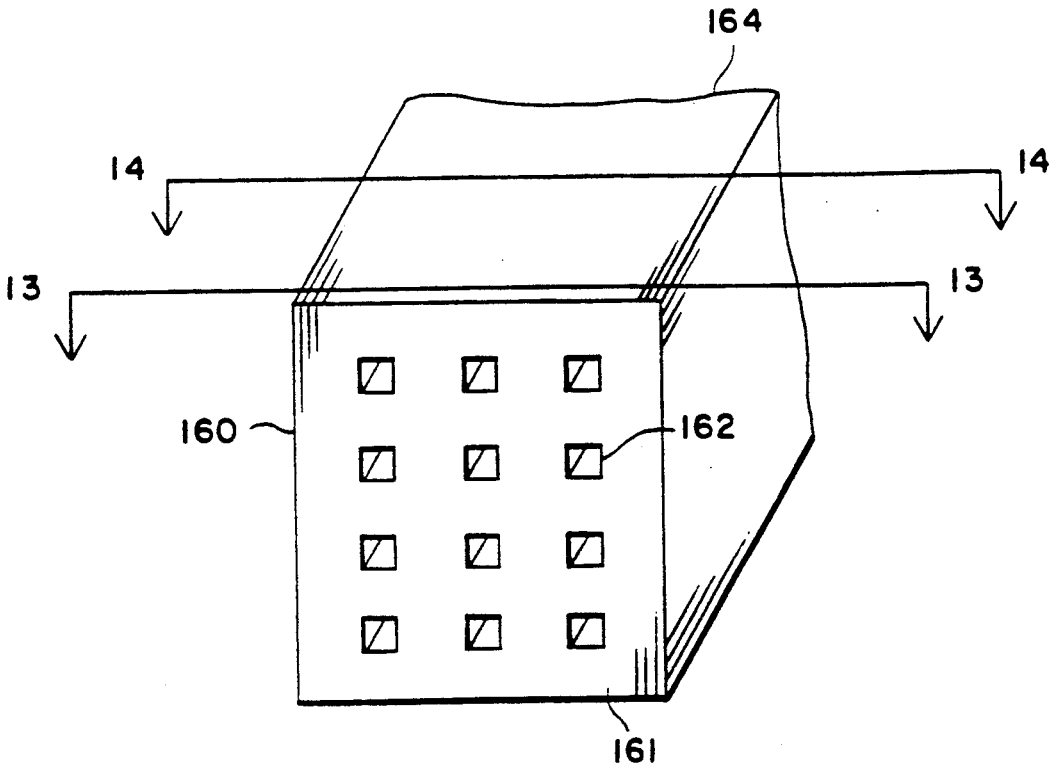
FIG. 12 is an alternative embodiment of a socket apparatus.

FIG. 12 shows a multi-terminal socket apparatus 160 where the openings of the receiving terminals 162 are flush with a surface 161 of a block 164. The block 164 may be molded plastic with retractable inserts which are withdrawn along an arc to form the helically-shaped receiving terminals 162. The interior surfaces 167 of the receiving terminals 162 are coated with an electrically conductive material. The coating may be applied by conventional processes which do not require further disclosure herein.

Figure 13:
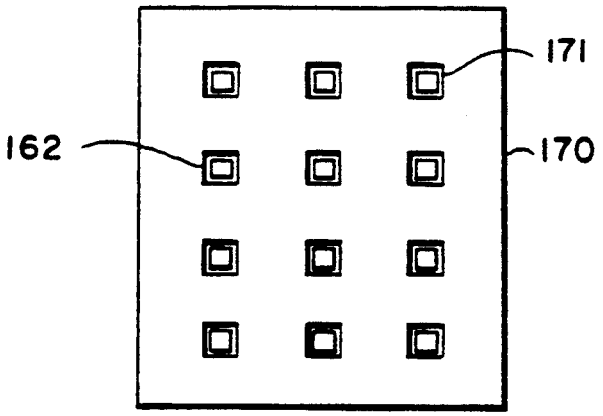
FIG. 13 is a sectional view along line 13—13 of the socket apparatus shown in FIG. 12.
Figure 14:
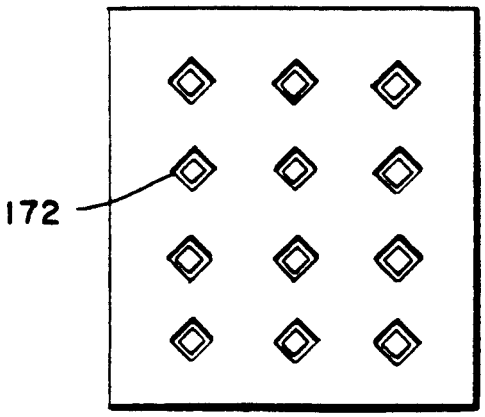
FIG. 14 is a sectional view along line 14—14 of the socket apparatus shown in FIG. 12.

FIG. 13 and FIG. 14 show cross-cut views of the socket apparatus shown in FIG. 12. FIG. 13 shows the cross-section at line 13—13 of the socket apparatus 160 showing the block surface 170, the conductive coating 171 on the interior surfaces, and the open ends of the receiving terminals 162.

FIG. 14 shows the cross-section at line 14—14 of the socket apparatus 160 of FIG. 12. The terminals 172 on this plane are oriented at 90 degrees with respect to the open ends of the receiving terminals on the block surface 170 to show the helical twist.

Figure 15:
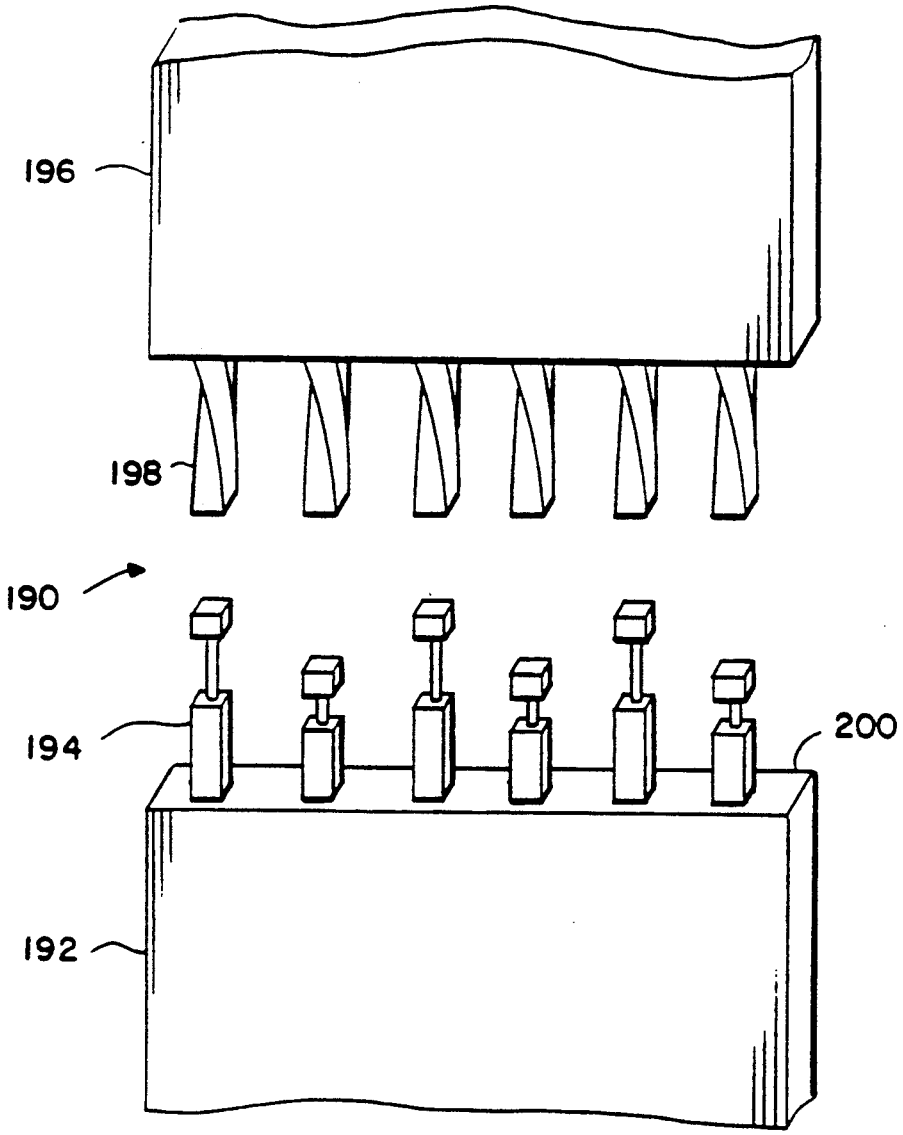
FIG. 15 is perspective view of a multi-terminal connector assembly.

FIG. 15 shows a multi-terminal electrical connector system 190 constructed in accordance with an alternative embodiment of the invention. The connector system 190 has a plug apparatus 192 with a plurality of insertion terminals 194 and a socket apparatus 196 with a plurality of receiving terminals 198. The insertion terminals 194 are of varying length with respect to the mounting plane 200 on the plug apparatus 192. The receiving terminals 198 are all constructed the same. Because of the various lengths of the insertion terminals 194, the peak insertion force when mating the plug apparatus 192 with the socket apparatus 196 is reduced. The insertion force is distributed during the process of insertion as different insertion terminals encounter torque at different points during mating.

Figure 16:
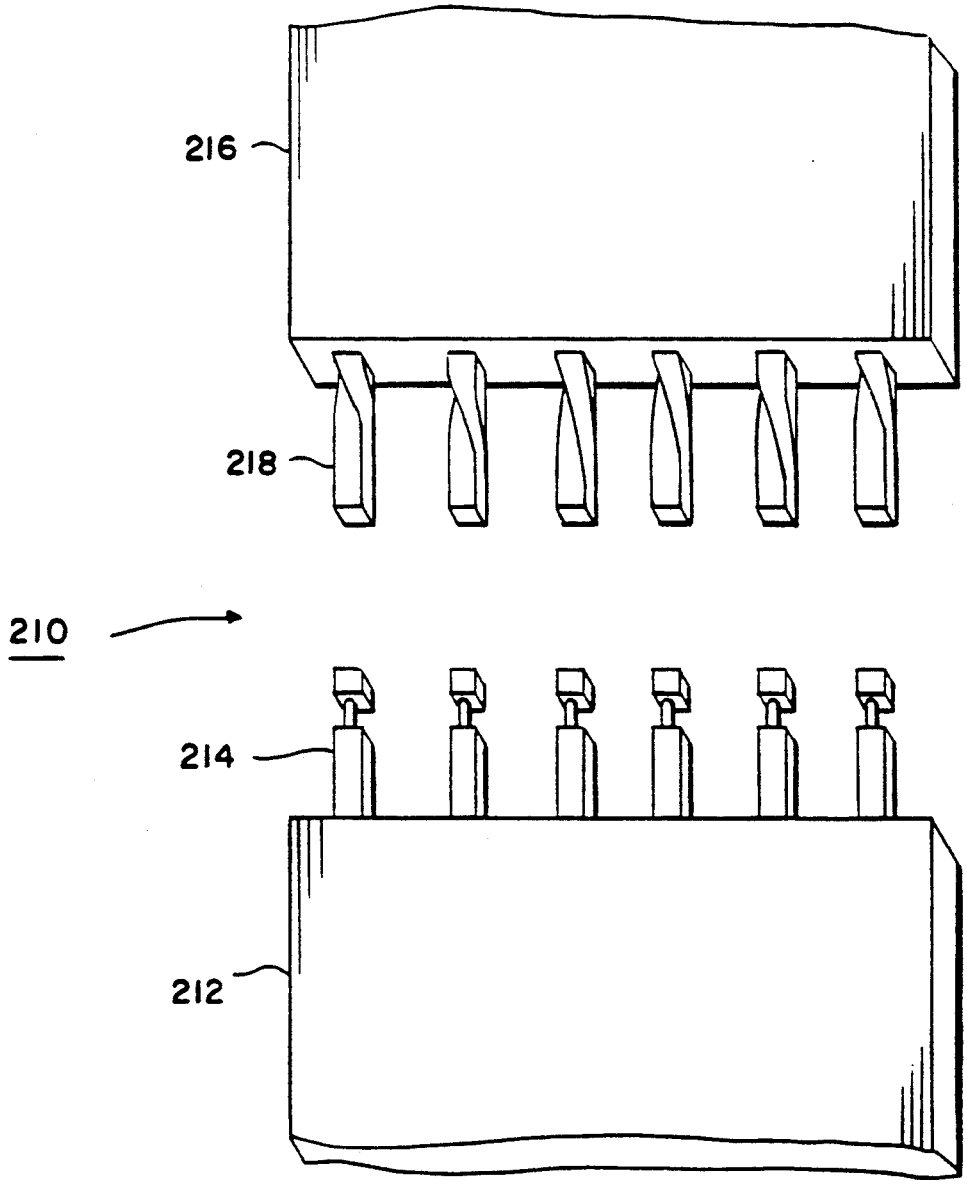

FIG. 16 shows a multi-terminal electrical connector system 210 constructed in accordance with an alternative embodiment of the invention. The connector system 210 has plug apparatus 212 with a plurality of insertion terminals 214 and a socket apparatus 216 with a plurality of receiving terminals 218. The receiving terminals 218 are all of equal overall length, however the helical curve is at different points on the different terminals. The distribution of helical curves among the receiving terminals reduces the peak insertion force when mating the plug apparatus 212 with socket apparatus 216. The insertion force is distributed during the process of insertion as different insertion terminals encounter the torque at different points in the receiving terminals.

What is claimed is:

1. An electrical connector system comprising: a first terminal including a first contact and a second contact connected by a shaft, said shaft formed of a resiliently deflectable material;

a second terminal having an elongated tubular shape, the interior surface of said second terminal defining substantially a helix to cause a rotational displacement of said first contact with respect to said second contact upon insertion of said first terminal into said second terminal, said rotational displacement resisted by said deflectable shaft to generate a locking contact force between said first terminal and said second terminal.

2. An electrical connector system as in claim 1 wherein said first terminal further comprises: said shaft formed of a resiliently deflectable electrically conductive material.

3. An electrical connector system as in claim 1 wherein said first contact and said second contact further include chamfered ends.

4. An electrical connector system as in claim 1 wherein said second electrical terminal further includes a flared opening for receiving said first electrical terminal.

5. An electrical connector system as in claim 1 wherein said first electrical terminal further comprises: a second shaft connected along said central axis coaxial with said first shaft and extending from said second contact away from said first contact.

6. An electrical connector system as in claim 1 wherein said interior surface of said second electrical terminal further comprises: a helically-shaped rectangular elongated tubular shape.

7. An electrical connector system as in claim 6 wherein said first contact and said second contact are rectangularly shaped to mate with said second electrical contact.

8. An electrical connector system comprising:

a first terminal including a first contact and a second contact connected by a shaft, said first contact and said second contact each having an elongated tubular shape, said first contact and said second contact each having at least one protrusion, said shaft formed of a resiliently deflectable electrically conductive material;

a second terminal having an elongated hollow tubular shape, the interior surface of said second terminal having at least one groove, said groove defining substantially a helix along said interior surface of said second terminal, said groove to cause a rotational displacement of said first contact with respect to said second contact upon insertion of said first terminal into said second terminal, said rotational displacement resisted by said deflectable shaft to generate a locking contact force between said first terminal and said second terminal.

9. An electrical connector system comprising:

a plurality of first electrical terminals, each said first electrical terminal having a base portion mounted to form a plug apparatus;

a plurality of second electrical terminals, said second electrical terminals mounted to form a socket apparatus, said socket apparatus adapted to mate with said plug apparatus;

said plurality of first electrical terminal each including a first contact and a second contact connected along a central axis by a shaft, said shaft formed of a resiliently deflectable electrically conductive material;

said plurality of second electrical terminal each having an elongated tubular shape, the interior surface of said second terminal defining substantially a helix to cause a rotational displacement of said first contact with respect to said second contact upon insertion of said first terminal into said second terminal, said rotational displacement resisted by said deflectable shaft to generate a locking contact force between said first terminal and said second terminal.

10. An electrical connector system as in claim 9 further comprising:

said socket apparatus and said plurality of second electrical terminals formed from a single piece of molded plastic, said interior surface of said second electrical terminal coated with a conductive material.

11. An electrical connector system as in claim 9 wherein said plurality of second electrical terminals are partitioned into a first group and a second group, and wherein said interior surfaces of said second electrical terminals of said first group define right-handed helixes, and wherein said interior surfaces of said second electrical terminals of said second group define lefthanded helixes.

12. An electrical connector system as in claim 9 wherein said socket apparatus further comprises: second electrical terminals rigidly mounted in said socket apparatus.

13. An electrical connector system as in claim 9 where said plug apparatus further comprises: said plurality of first electrical terminals having different lengths with respect to the mounting points of said first electrical terminals.

14. An electrical connector system as in claim 9 where said socket apparatus further comprises: said plurality of second electrical terminals wherein the helical curves occur at different distances from the receiving ends of said plurality of second electrical terminals.

* * * * *